US007124910B2

(12) United States Patent
Nordland

(10) Patent No.: US 7,124,910 B2
(45) Date of Patent: Oct. 24, 2006

(54) LEAK-RESISTANT POLYMERIC FOAM CONTAINERS

(75) Inventor: Kate E. Nordland, Rochester, NY (US)

(73) Assignee: Pactiv Corporation, Lake Forest, IL (US)

( * ) Notice: Subject to any disclaimer, the term of this patent is extended or adjusted under 35 U.S.C. 154(b) by 225 days.

(21) Appl. No.: 10/664,645

(22) Filed: Sep. 19, 2003

(65) Prior Publication Data

US 2005/0061810 A1 Mar. 24, 2005

(51) Int. Cl.
*B65D 43/16* (2006.01)
*B65D 43/03* (2006.01)
*B65D 1/24* (2006.01)
*B65D 25/04* (2006.01)

(52) U.S. Cl. ..... 220/839; 220/781; 220/4.23; 220/835; 220/791; 220/793; 206/505; 206/508

(58) Field of Classification Search ..... 220/4.21, 220/4.22, 4.23, 380, 555, 780–795, 835, 220/839; 206/505, 508; D9/426
See application file for complete search history.

(56) References Cited

U.S. PATENT DOCUMENTS 3,126,582 A 3/1964 Scott
3,183,291 A 5/1965 Miller et al.
3,284,553 A 11/1966 Edwards
3,293,697 A 12/1966 Balint
3,320,993 A * 5/1967 Motsenbocker ..... 220/780
3,337,664 A 8/1967 Lyon
3,530,537 A 9/1970 Walker
3,551,954 A 1/1971 Knowles
3,703,255 A 11/1972 Wade
3,902,540 A 9/1975 Commisso
3,955,710 A 5/1976 Commisso
3,967,991 A 7/1976 Shimano et al.
3,988,191 A 10/1976 Matsui
3,995,763 A 12/1976 Ayres et al.
4,060,577 A 11/1977 Collins
4,073,609 A 2/1978 Petrenchik
4,079,880 A * 3/1978 Edwards ..... 220/4.21
4,108,347 A 8/1978 Amberg
4,113,824 A 9/1978 Matsui et al.
4,121,402 A 10/1978 Cress et al.
4,127,189 A * 11/1978 Shumrak et al. ..... 206/520
4,127,378 A 11/1978 Meadors
4,132,344 A * 1/1979 Jewell ..... 229/406
4,183,446 A * 1/1980 Davis ..... 220/4.23
D259,543 S 6/1981 Commisso et al.
4,281,979 A 8/1981 Doherty et al.
4,286,766 A 9/1981 von Holdt
4,298,133 A * 11/1981 Davis ..... 220/4.23
D262,944 S 2/1982 Commisso
D263,023 S 2/1982 Commisso
4,332,332 A * 6/1982 Ingemann ..... 220/276

(Continued)

*Primary Examiner*—Nathan J. Newhouse
*Assistant Examiner*—James Smalley
(74) *Attorney, Agent, or Firm*—Baker Botts L.L.P.

(57) ABSTRACT

A leak-resistant hinged polymeric foam container comprises a base and a lid. The base comprises a bottom wall and a sidewall that encompasses and extends generally upwardly from the bottom wall. The sidewall comprises a first sealing area and a first generally upwardly projecting wall. The lid includes a second sealing area that is adapted to engage the first sealing area upon securing the lid and the base. The container forms a locking structure for securing the lid and the base. The base and the lid comprise polymeric foams. The container may include a hinge that hingedly connects the base to the lid.

46 Claims, 9 Drawing Sheets

U.S. PATENT DOCUMENTS 4,359,160 A 11/1982 Myers et al.
D267,703 S 1/1983 Chase et al.
4,383,819 A 5/1983 Letica
4,386,044 A 5/1983 Arndt et al.
D269,854 S 7/1983 Commisso
D272,595 S 2/1984 Chase et al.
4,442,064 A 4/1984 Myers et al.
4,446,088 A 5/1984 Daines
4,488,658 A * 12/1984 Smith et al. ..... 220/276
4,502,660 A 3/1985 Luther et al.
4,534,927 A 8/1985 Morioka et al.
4,609,339 A 9/1986 Padovani
4,627,810 A 12/1986 Von Holdt
4,690,666 A 9/1987 Alexander et al.
4,705,172 A 11/1987 Gage
4,795,056 A 1/1989 Meyers
4,822,553 A 4/1989 Marshall
D303,633 S 9/1989 Terauds
4,878,970 A 11/1989 Schubert et al.
4,915,251 A * 4/1990 Payne ..... 220/4.23
D308,826 S 6/1990 Cyr et al.
4,974,738 A * 12/1990 Kidd et al. ..... 220/4.24
5,015,169 A 5/1991 Inzinna et al.
D317,410 S * 6/1991 Ott et al. ..... D9/426
5,029,725 A * 7/1991 Roth ..... 220/655
5,092,479 A * 3/1992 Wells ..... 220/4.23
5,118,277 A 6/1992 Padovani
5,220,999 A 6/1993 Goulette
5,269,430 A * 12/1993 Schlaupitz et al. ..... 220/4.23
5,368,469 A 11/1994 Ekkert
D353,327 S 12/1994 Castner et al.
D364,090 S 11/1995 Krupa
5,507,406 A * 4/1996 Urciuoli et al. ..... 220/269
D373,954 S 9/1996 Wolff
5,637,332 A 6/1997 Ridout
5,693,388 A 12/1997 Castner et al.
5,758,791 A * 6/1998 Mangla ..... 220/4.21
5,860,530 A 1/1999 Simmons et al.
5,947,321 A 9/1999 Vadney
D415,025 S 10/1999 McCann
5,979,687 A 11/1999 Hayes et al.
5,984,130 A 11/1999 Hayes et al.
6,010,062 A 1/2000 Shimono
6,087,447 A * 7/2000 Stevens et al. ..... 525/211
6,093,352 A * 7/2000 Miller et al. ..... 264/50
6,093,752 A * 7/2000 Park et al. ..... 521/139
6,261,504 B1 7/2001 Baker et al.
D450,537 S 11/2001 Hayes
D450,580 S 11/2001 Littlejohn et al.
6,460,716 B1 * 10/2002 Wong ..... 220/4.24
D468,202 S 1/2003 Chou
6,688,487 B1 * 2/2004 Oakes et al. ..... 220/788
6,883,678 B1 * 4/2005 Chou ..... 220/793
2005/0017007 A1 * 1/2005 Sellari et al. ..... 220/270

* cited by examiner

LEAK-RESISTANT POLYMERIC FOAM CONTAINERS

FIELD OF THE INVENTION

The present invention relates generally to containers. More particularly, the invention relates to polymeric foam containers such as hinged-lid containers with improved leak resistance.

BACKGROUND OF THE INVENTION

Many types of foam containers have been used in the past for a variety of purposes. One type of these polymeric containers is a foam container that includes a base and a hinged lid. One of the most common uses for such containers is for holding food, either to package food when purchased or for holding leftovers from a purchased meal. One advantage of these containers is their insulative properties that keep food hot or cold in the containers until the food can be properly stored.

These containers, however, have the disadvantage of liquids leaking from the container. Leakage may occur at many locations from the container. For example, the liquid may leak at the location of a hinge and/or at a slot in the container used to lock the lid and the base. The hinge of these containers typically interrupts a seal formed between lid and the base, while the slot is an opening in the base of the container. Leakage may also occur around the rims of these containers where an incomplete seal exists between the lid and base. The leakage is often most pronounced when the container is tilted at extreme angles relative to a general horizontal position. It would be desirable to provide a foam container that can be handled that prevents or inhibits liquid from leaking therefrom.

SUMMARY OF THE INVENTION

According to one embodiment, a leak-resistant hinged polymeric foam container comprises a base, a hinge and a lid. The base comprises a bottom wall and a sidewall encompassing and extending generally upwardly from the bottom wall. The sidewall comprises a first sealing area and a first generally upwardly projecting wall. The first sealing area includes a first generally outwardly projecting ledge, a second generally outwardly projecting ledge, and a second generally upwardly projecting wall. The second generally upwardly projecting wall encompasses and extends generally upwardly from the second generally outwardly projecting ledge. The first generally outwardly projecting ledge encompasses and extends generally outwardly from the second generally upwardly projecting wall. The first generally upwardly projecting wall encompasses and extends generally upwardly from the first generally outwardly projecting ledge.

The hinge is connected to the base. The lid is hingedly connected to the base by the hinge. The lid is adapted to be pivoted about the hinge to engage the base upon closure of the container. The lid includes a second sealing area that is adapted to engage the first sealing area upon securing the lid and the base. The container forms locking means for securing the lid and the base. The base comprises a polymeric foam and the lid comprises a polymeric foam. One example of locking means is at least one undercut. According to one method, this container may be made by providing a foamable resin in an extruder. The foamable resin is melted in the extruder and then the foamable resin is extruded from the extruder to form an extruded material. The extruded material is thermoformed into the container.

According to another embodiment, a leak-resistant polymeric foam container comprises a base and a lid. The base comprises a bottom wall and a sidewall encompassing and extending generally upwardly from the bottom wall. The sidewall comprises a first sealing area and a first generally upwardly projecting wall. The first sealing area includes a first generally outwardly projecting ledge, a second generally outwardly projecting ledge, and a second generally upwardly projecting wall. The second generally upwardly projecting wall encompasses and extends generally upwardly from the second generally outwardly projecting ledge. The first generally outwardly projecting ledge encompasses and extends generally outwardly from the second generally upwardly projecting wall. The first generally upwardly projecting wall encompasses and extends generally upwardly from the first generally outwardly projecting ledge.

The lid is configured to mate with the base to form a closed position. The lid includes a second sealing area that is adapted to engage the first sealing area upon securing the lid and the base to form the closed position. The container forms locking means for securing the lid and the base. The base comprises a polymeric foam and the lid comprises a polymeric foam. One example of locking means is at least one undercut.

According to a further embodiment, a leak-resistant hinged polymeric foam container comprises a base, a hinge and a lid. The base comprises a bottom wall and a sidewall encompassing and extending generally upwardly from the bottom wall. The sidewall comprises a first sealing area and a first generally upwardly projecting wall. The hinge is connected to the base. The hinge, when in a closed position, comprises a first generally horizontal portion, a second generally horizontal portion, and a first generally vertical portion that are integrally connected to each other. The second generally horizontal portion is folded over the first generally horizontal portion. The first generally vertical portion extends generally downwardly from the second generally horizontal portion towards the bottom wall. The lid is hingedly connected to the base by the hinge. The lid is adapted to be pivoted about the hinge to engage the base upon closure of the container. The lid includes a second sealing area that is adapted to engage the first sealing area upon securing the lid and the base. The container forms locking means for securing the lid and the base. The base comprises a polymeric foam and the lid comprises a polymeric foam. One example of locking means is at least one undercut.

According to yet another embodiment, a leak-resistant hinged polymeric foam container comprises a base, a hinge and a lid. The base comprises a bottom wall and a sidewall encompassing and extending generally upwardly from the bottom wall. The sidewall comprises a first sealing area and a first generally upwardly projecting wall. The first sealing area includes a first generally outwardly projecting ledge, a second generally outwardly projecting ledge, and a second generally upwardly projecting wall. The second generally upwardly projecting wall encompasses and extends generally upwardly from the second generally outwardly projecting ledge. The first generally outwardly projecting ledge encompasses and extends generally outwardly from the second generally upwardly projecting wall. The first generally upwardly projecting wall encompasses and extends generally upwardly from the first generally outwardly projecting ledge.

The hinge is connected to the base. The lid is hingedly connected to the base by the hinge. The lid is adapted to be pivoted about the hinge to engage the base upon closure of the container. The lid includes a second sealing area that is adapted to engage the first sealing area upon securing the lid and the base. One of the first sealing area and the second sealing area forms a projection and the other one of the first sealing area and the second sealing area forms a corresponding recess for securing the lid and the base. The base comprises a polymeric foam and the lid comprises a polymeric foam.

According to yet a further embodiment, a leak-resistant polymeric foam container comprises a base and a lid. The base comprises a bottom wall and a sidewall encompassing and extending generally upwardly from the bottom wall. The sidewall comprises a first sealing area and a first generally upwardly projecting wall. The first sealing area includes a first generally outwardly projecting ledge, a second generally outwardly projecting ledge, and a second generally upwardly projecting wall. The second generally upwardly projecting wall encompasses and extends generally upwardly from the second generally outwardly projecting ledge. The first generally outwardly projecting ledge encompasses and extends generally outwardly from the second generally upwardly projecting wall. The first generally upwardly projecting wall encompasses and extends generally upwardly from the first generally outwardly projecting ledge.

The lid is configured to mate with the base to form a closed position. The lid includes a second sealing area that is adapted to engage the first sealing area upon securing the lid and the base to form the closed position. One of the first sealing area and the second sealing area forms a projection and the other one of the first sealing area and the second sealing area forms a corresponding recess for securing the lid and the base. The base comprises a polymeric foam and the lid comprises a polymeric foam.

According to another embodiment, a leak-resistant hinged polymeric foam container comprises a base, a hinge and a lid. The base comprises a bottom wall and a sidewall encompassing and extending generally upwardly from the bottom wall. The sidewall comprises a first sealing area and a first generally upwardly projecting wall. The hinge is connected to the base. The hinge, when in a closed position, comprises a first generally horizontal portion, a second generally horizontal portion, and a first generally vertical portion that are integrally connected to each other. The second generally horizontal portion is folded over the first generally horizontal portion. The first generally vertical portion extends generally downwardly from the second generally horizontal portion towards the bottom wall. The lid is hingedly connected to the base by the hinge. The lid is adapted to be pivoted about the hinge to engage the base upon closure of the container. The lid includes a second sealing area that is adapted to engage the first sealing area upon securing the lid and the base. One of the first sealing area and the second sealing area forms a projection and the other one of the first sealing area and the second sealing area forms a corresponding recess for securing the lid and the base. The base comprises a polymeric foam and the lid comprises a polymeric foam.

BRIEF DESCRIPTION OF THE DRAWINGS

Other advantages of the invention will become apparent on reading the following detailed description and on reference to the drawings in which.

DETAILED DESCRIPTION OF THE ILLUSTRATED EMBODIMENTS

Figure 1:
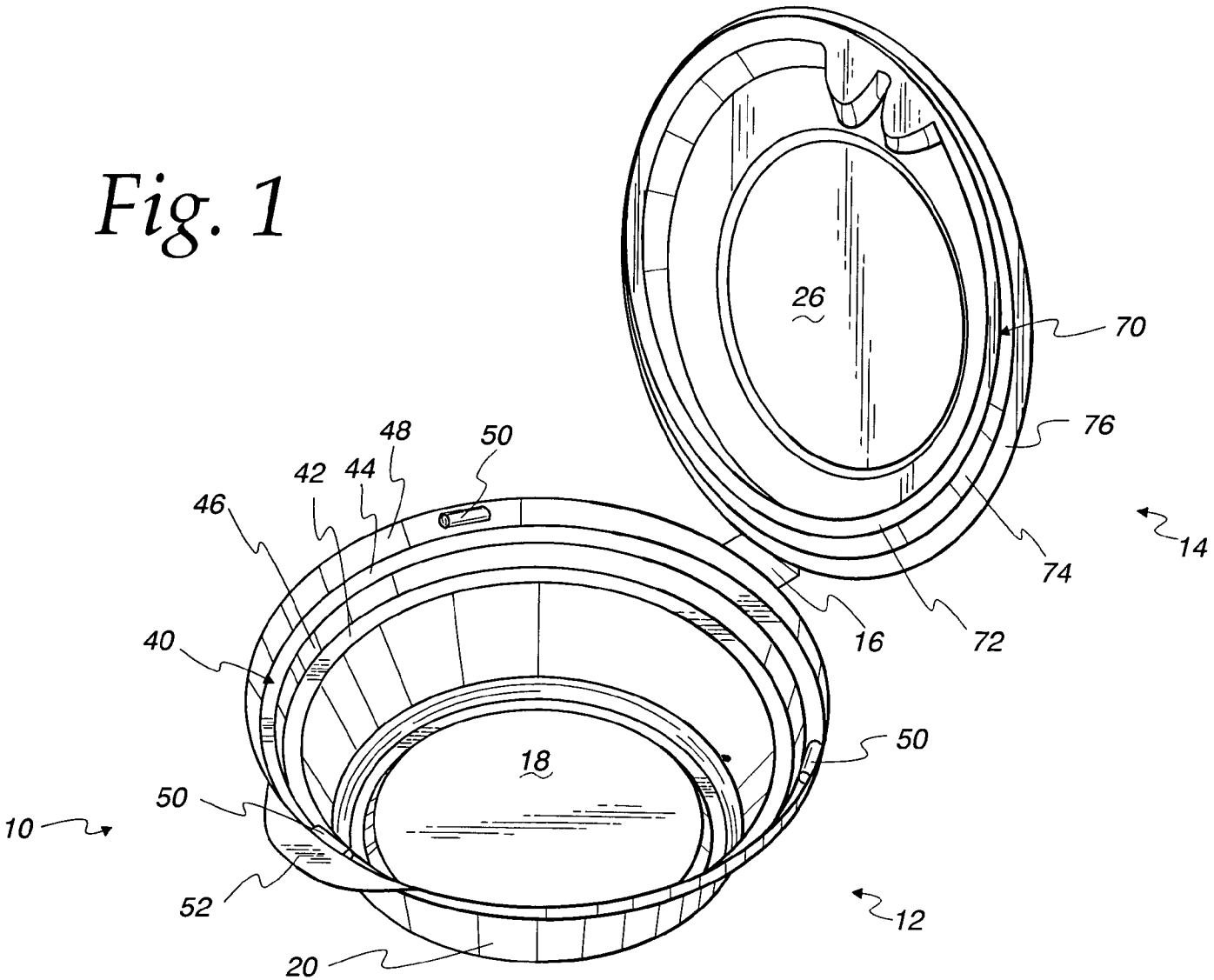
FIG. 1 is a perspective view of a leak-resistant hinged container in an open configuration according to one embodiment of the present invention.
Figure 2:
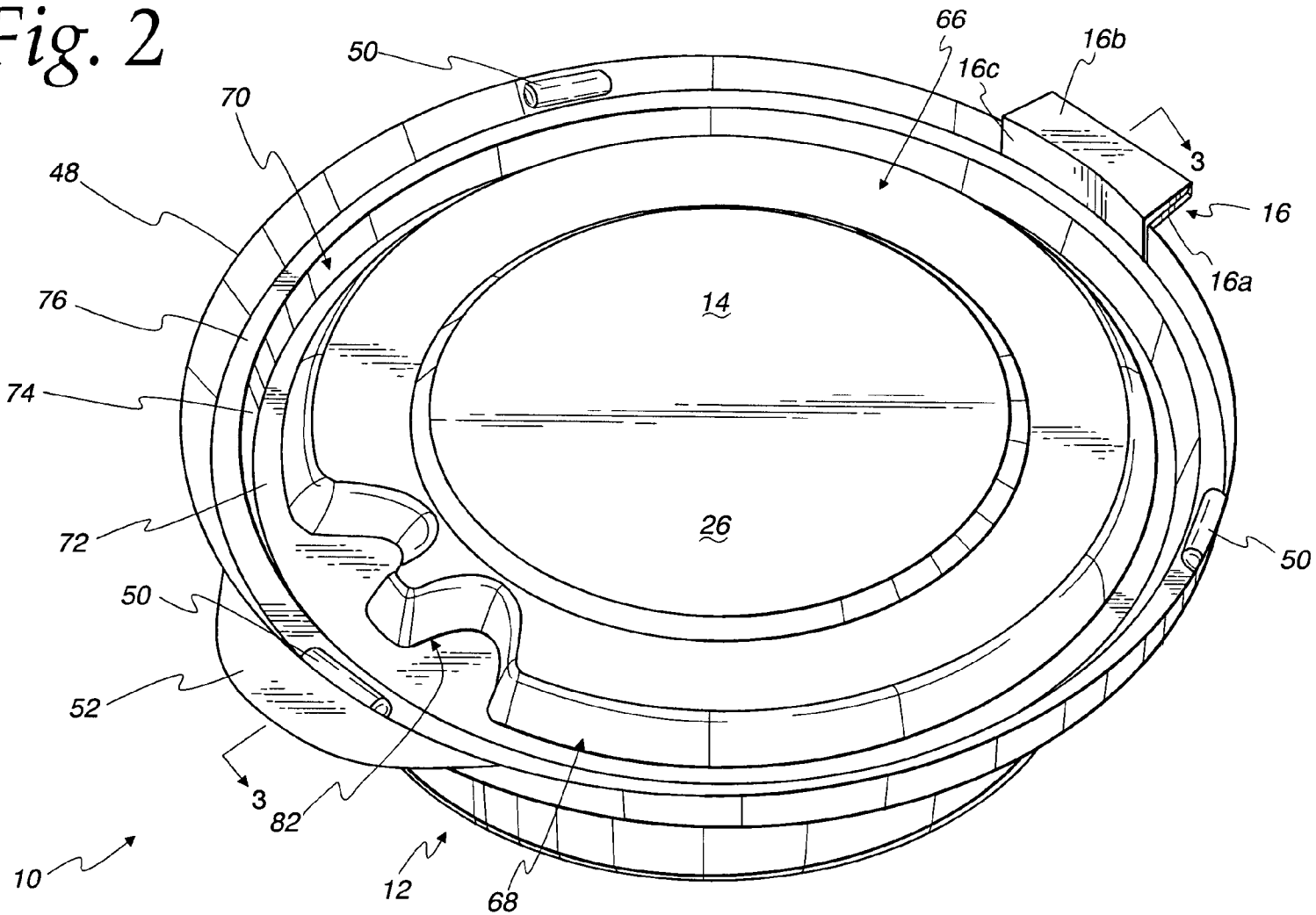
FIG. 2 is a perspective view of the container of FIG. 1 in the closed configuration.

Referring now to FIGS. 1–3, 4*a* and 5, there is illustrated a leak-resistant polymeric foam container 10 according to one embodiment of the present invention. The foam container 10 includes a base 12 and a lid 14. The lid 14 is connected to the base 12 by a hinge 16 allowing the lid 14 to be pivoted about the hinge 16 between a container open position (FIG. 1) and a container closed position (FIG. 2). The hinge 16 is shown as being integral with the base 12 and the lid 14 in FIGS. 1 and 2. Other embodiments of the present invention are shown in FIGS. 6 and 7, and FIG. 8 with polymeric foam containers 100 and 200, respectively.

Figure 6:
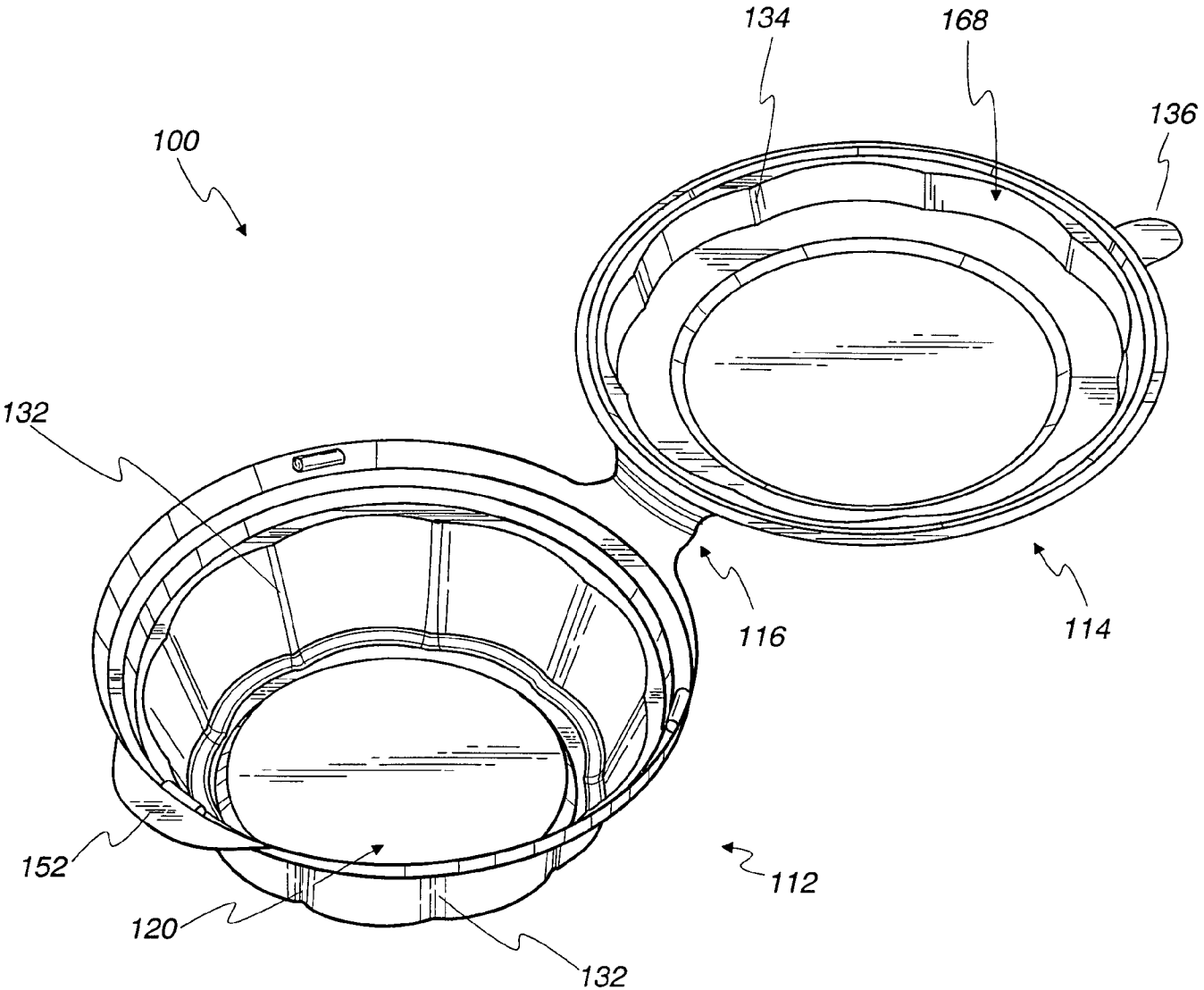
FIG. 6 is a perspective view of a leak-resistant hinged container in an open configuration according to another embodiment of the present invention.
Figure 7:
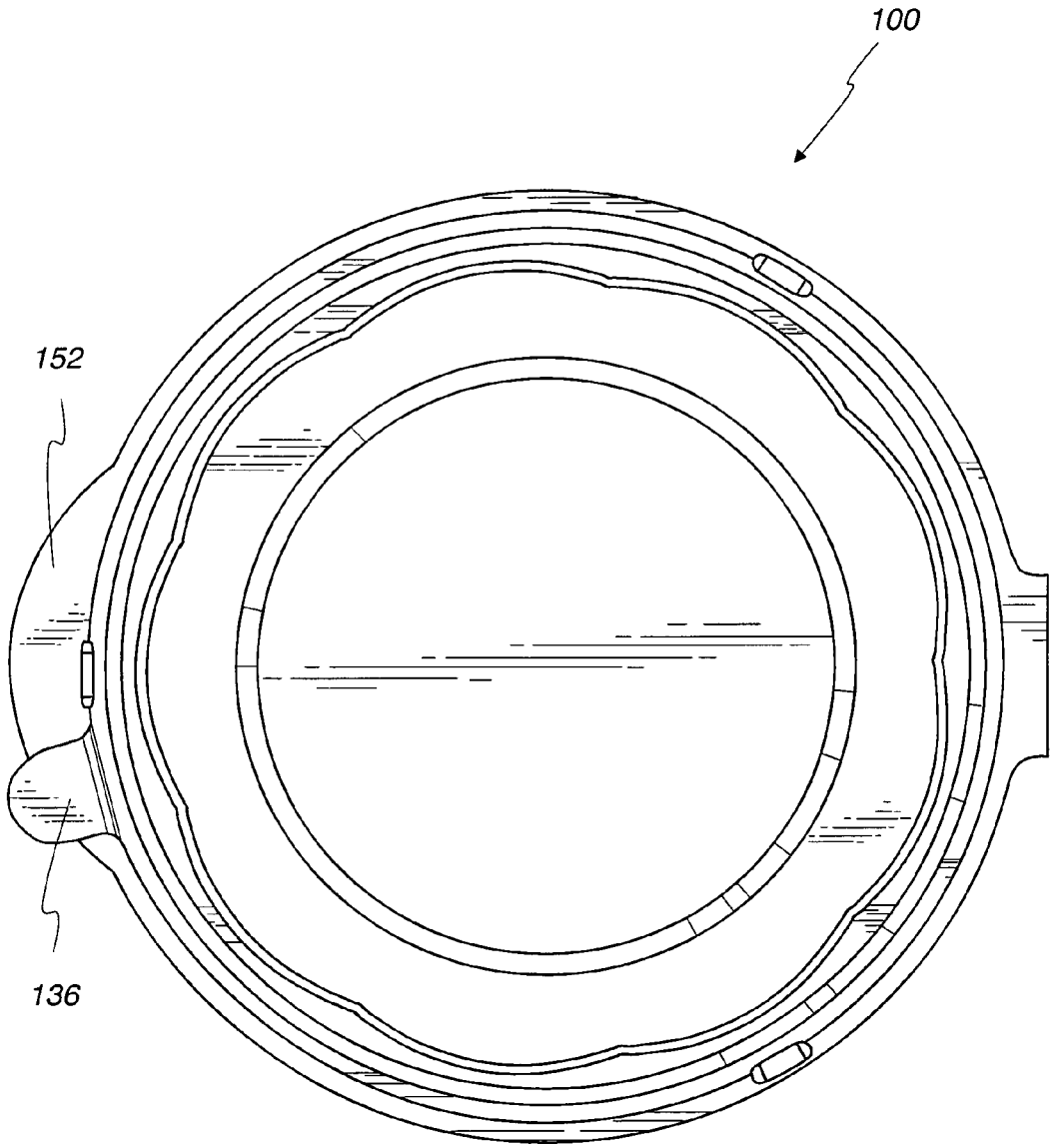
FIG. 7 is a top view of the container of FIG. 6.
Figure 8:
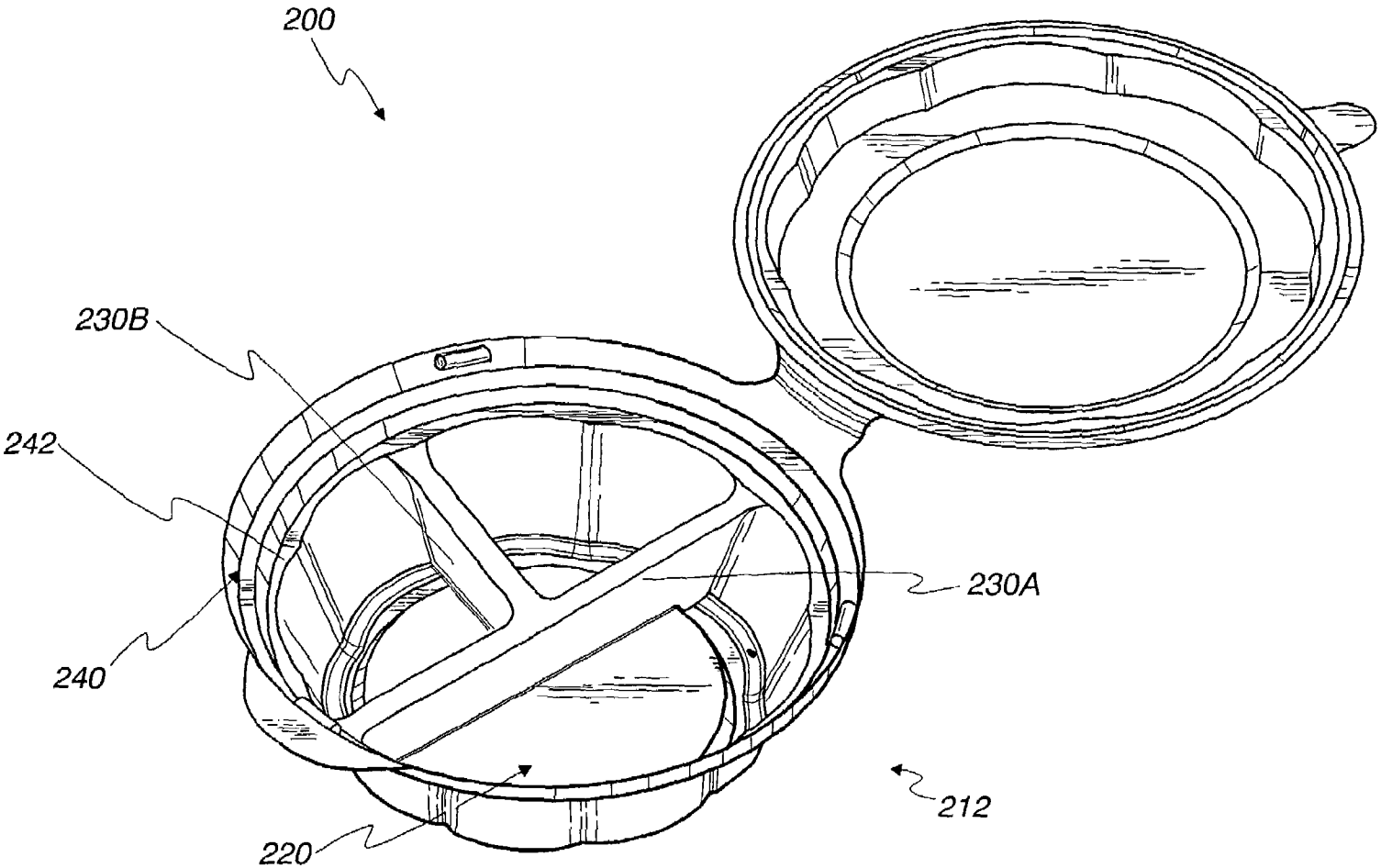
FIG. 8 is a perspective view of a leak-resistant hinged container in an open configuration according to a further embodiment of the present invention.

According to other embodiments, leak-resistant polymeric foam containers comprise a base and a lid such as shown in FIGS. 1, 6 and 8, but without a hinge. In other words, the containers are formed using separate and distinct bases and lids.

Figure 3:
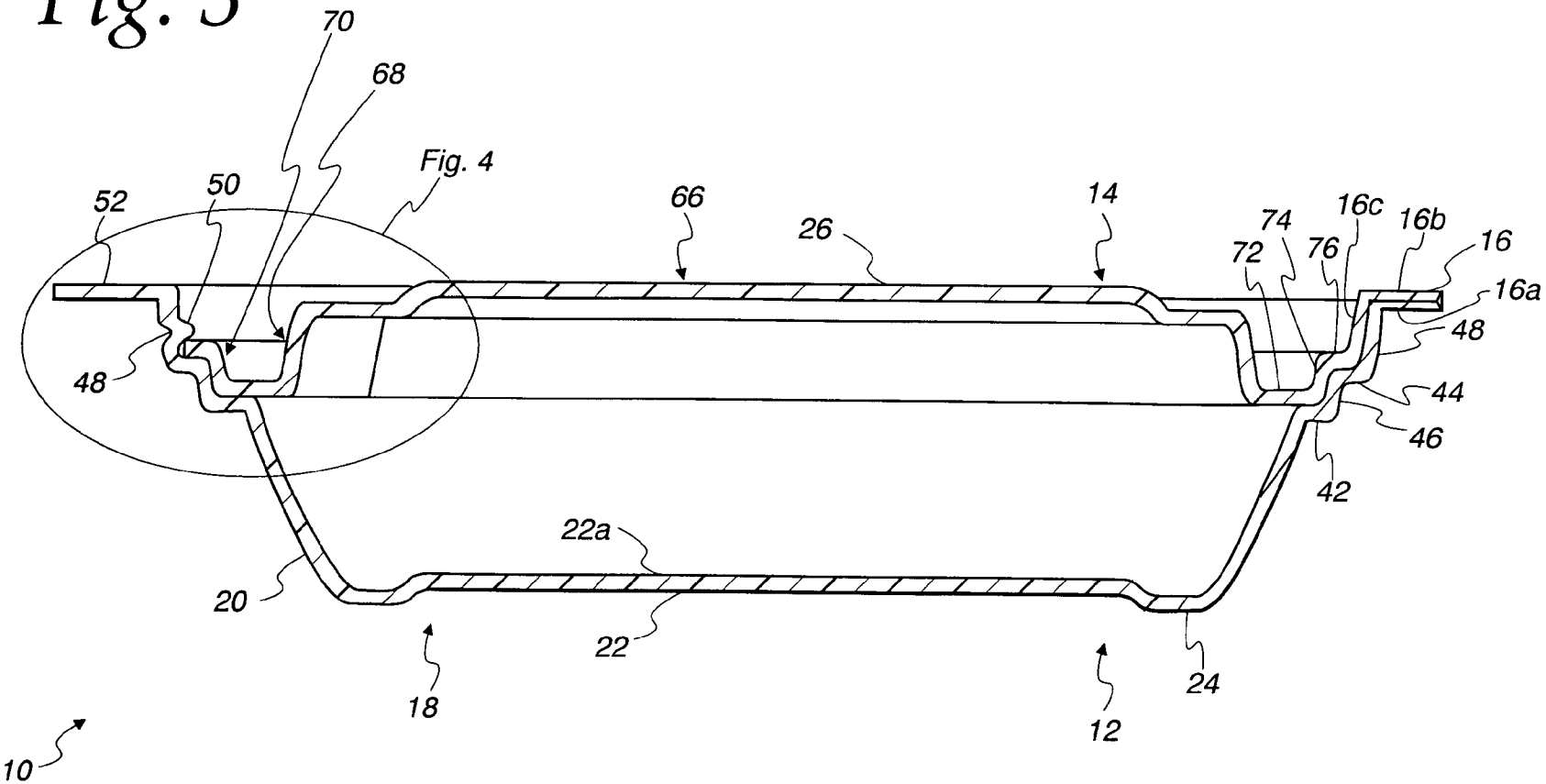
FIG. 3 is an enlarged cross-sectional view of the container of FIG. 2 taken generally along line 3—3 in FIG. 2.

The base 12 includes a bottom wall 18 and a sidewall 20 that encompasses and extends generally upwardly therefrom. As shown in FIG. 3, the bottom wall 18 includes a recessed portion 22 with an upper surface 22*a* that extends above a remainder 24 of the bottom wall 18. The upper surface 22*a* of the recessed portion 22 functions to hold food above the remainder 24 of the bottom wall 18 and away from liquids that collect in the remainder 24 of the bottom wall 18. In addition, when several containers 10 are stacked on each other, a raised portion 26 on the lid 14 of one container corresponds to or fits into the underside of the recessed portion 22 formed in a base 12 of another container. This fit tends to prevent or inhibit stacked containers from sliding relative to each other and, thus, assists in stacking a plurality of containers. It is contemplated that the upper surface of the container may include a recessed portion that is adapted to fit in a raised portion of a base of another container.

Referring back to FIG. 1, to assist in providing leak-resistance to the container 10 of the present invention, the sidewall 20 of the base 12 forms a first sealing area 40. The first sealing area includes a first generally outwardly projecting ledge 44, a second generally outwardly projecting ledge 42, and a second generally upwardly projecting wall 46. More specifically, the first generally outwardly projecting ledge 44 is a generally horizontal ledge, the second generally outwardly projecting ledge 42 is a generally horizontal ledge, and the second generally upwardly projecting wall 46 is a generally vertical wall. It is contemplated that the ledges 42 and 46 may be substantially horizontal and the wall 46 may be substantially vertical.

The sidewall 20 of the container 10 also includes a first generally upwardly projecting wall 48. More specifically, the first generally upwardly projecting wall 48 is a generally vertical wall. The second generally upwardly projecting wall 46 encompasses and extends generally upwardly from the second generally outwardly projecting ledge 42. The first generally outwardly projecting ledge 44 encompasses and extends outwardly from the second upwardly projecting wall 46. The first generally upwardly projecting wall 48 encompasses and extends generally upwardly from the first generally outwardly projecting ledge 44.

Figure 5:
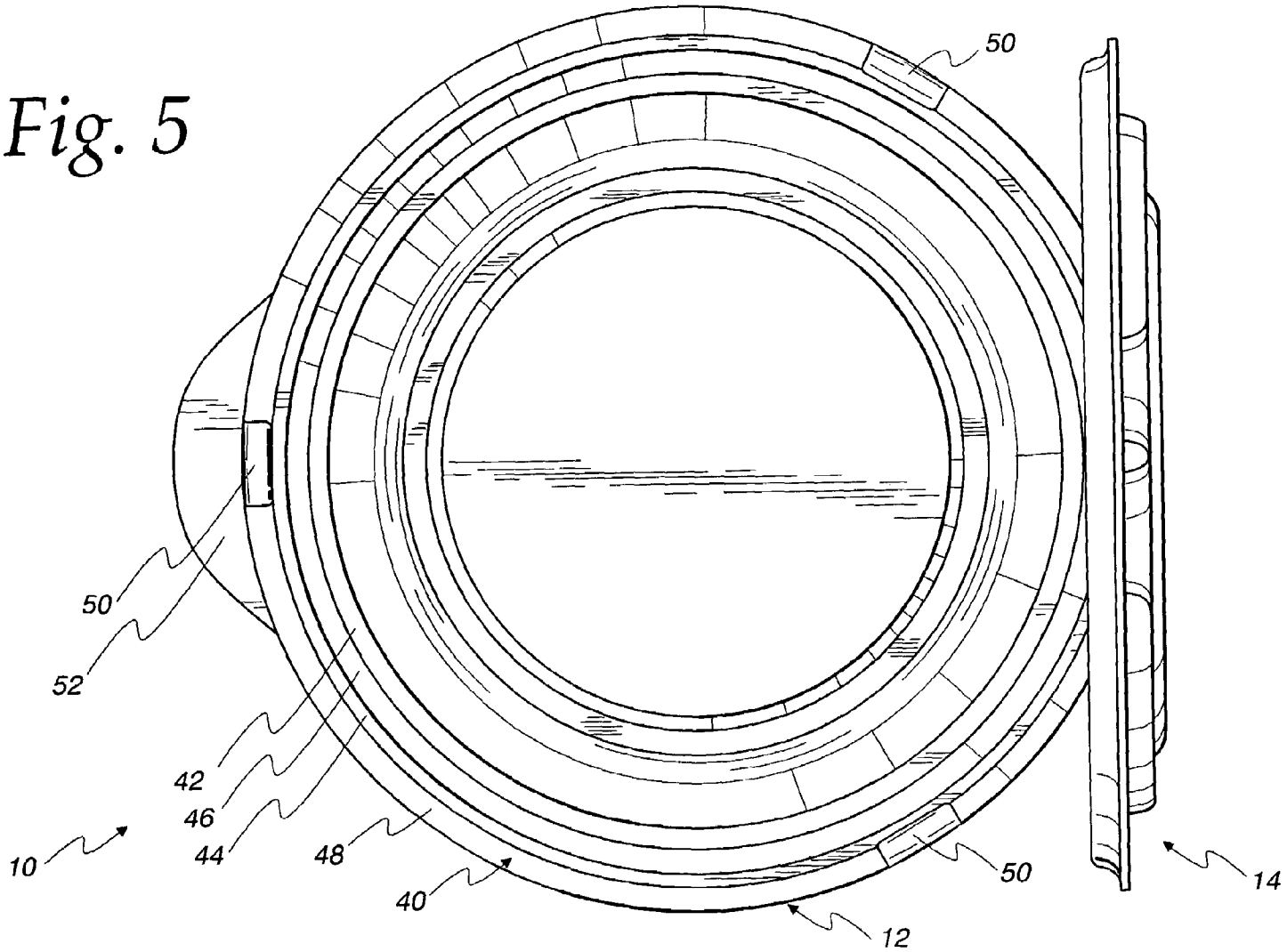
FIG. 5 is a top view of the container of FIG. 1 in an open configuration.

The first sealing area 40 of the base 12 as shown in FIGS. 1 and 5 is an uninterrupted or continuous surface that extends around the entire periphery of the base 12. The first sealing area is preferably an uninterrupted or continuous surface so as to assist in preventing or inhibiting leakage from the container. To allow an uninterrupted seal to be formed upon closure of the lid 14 on the base 12, the first sealing area 40 of FIG. 1 is spaced from the hinge 16. It is contemplated that the container may have a first sealing area formed by less than three surfaces of the base. For example, the container may have one or two surfaces of the lid that forms the first sealing area. It is contemplated that the first sealing area may be formed by two non-contiguous surfaces. For example, the sealing area may be two generally horizontal surfaces or two generally vertical surfaces that are spaced apart from reach other. It is contemplated that the sealing surfaces may be discontinuous around the periphery of the base.

Referring to FIGS. 1 and 3–4*a*, the first generally upwardly projecting wall 48 of the base 12 forms a plurality of undercuts 50 therein. The plurality of undercuts assists in forming a leak-resistant container when they extend over a second sealing area of the lid 14 upon closure of the container to lock the lid onto the base. The plurality of undercuts assists in maintaining the lid and the base in a closed position. The plurality of undercuts desirably forms a generally consistent downward pressure across the outer circumference of the lid 14. The plurality of undercuts 50 is, in simplest terms, pushed-in sections of the first generally upwardly projecting wall 48 that do not form an opening therein that could lead to liquid leakage. The use of a plurality of undercuts is desirable because they form an improved seal as compared to slots or cut-outs in combination with tab closures because of the elimination of holes.

It is also contemplated that the base 12 may form at least one undercut therein. One method of forming the plurality of undercuts 50 is described in U.S. Pat. No. 6,261,504 B1. It is contemplated that the at least one undercut may be formed by other methods.

Alternatively, the first generally upwardly projecting wall 48 of the base may form slots or cut-outs that are used with tab closures to assist in locking the lid into the base. It is also contemplated that the lid may remain closed or locked to the base by using one continuous undercut ring. The continuous undercut ring, according to one embodiment, would extend substantially around the inner surface of a generally upwardly projecting wall such as, for example, the first generally upwardly projecting wall 48 of FIG. 1. It is contemplated that the undercut ring may be discontinuous by only extending partially around the first generally upwardly projecting wall. It is also contemplated that two or more of the at least one undercut, slot and tab closures, a continuous undercut ring, and a discontinuous undercut ring may be combined together to form the sealing area.

Referring back to FIGS. 1, 2 and 5, the base 12 further includes a tab extension 52 to assist in opening the container from a closed position. The tab extension 52 also assists in closing the container from an open position. The tab extension 52 encompasses and extends outwardly from the first generally upwardly projecting wall 48 of the base 12. The tab extension 52 is shown in FIGS. 1, 2 and 5 as being generally circular or oval in shape. It is contemplated that the tab extension, if used, may be shaped differently such as, for example, rectangular, square or other polygonal shapes. It is desirable for the tab extension 52 to be located generally opposite of the hinge to better assist a user in opening the container from a closed position. It is contemplated, however, that the tab extension may be located in a different position than depicted, for example, in FIG. 2. It is also contemplated that more than one tab extension may be formed in the container.

The base 12 is intended to hold objects such as food and may include optional divider walls of any configuration desired for its intended use. The optional divider walls define separate compartments in the base. Different food may be placed in the separate compartments with the divider walls to prevent or inhibit mixing of the different food and their juices. To provide improved stability to the container, the divider walls of the base may flare at their respective ends to define a flat surface.

One example of such a container with divider walls is depicted in FIG. 8. The container 200 of FIG. 8 includes a base 212 and a plurality of divider walls 230 that includes a first divider wall 230*a* and a second divider wall 230*b*. The first divider wall 230*a* extends across a sidewall 220 of the base 212 and the second divider wall 230*b* extends from the first divider wall 230*a* to one portion of the sidewall 220. The divider walls 230*a,b* will typically not extend upwardly to a generally outwardly projecting ledge 242 of the sidewall 220 because of the potential to interfere with sealing area 240.

The sidewalls of the containers may include features such as ribs. For example, as shown in FIG. 6, the container 100 includes a sidewall 120 that forms a plurality of ribs 132. The number of ribs, if any, on the sidewall may vary from that shown in the container 100 of FIG. 6. The container 100 of FIG. 6 includes nine ribs that are spaced generally equidistance from each other. The portion of the sidewall 120 with the plurality of ribs 132 is shaped in a scalloped manner (i.e., a plurality of distinct outwardly concave projections as viewed from an interior of the base).

The hinge 16 is shown in FIGS. 1–3 as being integral with a portion of the lid 14 and a portion of the base 12. The lid 14 is hingedly connected to the base 12 by the hinge 16 such that the lid 14 is adapted to be pivoted about the hinge 16 to engage the base 12 upon closure of the container 10. The hinged area in at least some prior art hinged-containers tended to produce undesirable leakage. To assist in preventing or inhibiting leakage, the configuration of the hinge 16 allows the hinged area to complete the seal of the lid 14 to the base 12. The hinge 16 preferably does not interrupt the first sealing area 40 of the base 12 or the second sealing area 70 of the lid 14.

As shown in FIG. 2, the hinge 16 comprises a first hinge portion 16*a*, a second hinge portion 16*b*, and a third hinge portion 16*c*, which are integrally connected with each other. The hinge 16 is formed to allow sufficient movement or "play" to close the container. This sufficient movement assists in easier closure of the base and lid by the user. In the locked position of the base and lid, the third hinge portion 16*c* extends generally downward from about an upper edge of the projecting wall 48. The third hinge portion generally extends downwardly from about ¼ to about ¾ of an inch from the upper edge of the projecting wall 48.

The lid 14 of FIGS. 2 and 3 includes a top surface 66 and a peripheral sidewall 68 that encompasses and extending therearound. The top surface 66 of the lid 14 includes a raised portion 26 that allows stacking of the containers 10. It is also contemplated that the raised portion may be instead recessed so as to allow stacking of the containers.

To assist in providing leak-resistance to the container 10 of the present invention, the lid 14 further includes a second sealing area 70. The second sealing area 70 encompasses and extends generally outwardly from the peripheral sidewall 68. The second sealing area 70 includes a first generally outwardly projecting surface 76, a second generally outwardly projecting surface 72, and a first generally upwardly projecting wall 74. More specifically, the first generally outwardly projecting surface 76 is a generally horizontal surface, the second generally outwardly projecting surface 72 is a generally horizontal surface, and the first generally upwardly projecting wall 74 is a generally vertical wall. It is contemplated that the surfaces 72 and 76 may be substantially horizontal and the wall 74 may be substantially vertical. The first generally upwardly projecting wall 74 encompasses and bridges the surfaces 72, 76. The second generally outwardly projecting surface 72 encompasses and extends outwardly from the peripheral sidewall 68.

The second sealing area 70 of the lid 14 of FIG. 2 is an uninterrupted or continuous surface that extends around the entire periphery of the lid 14. The second sealing area 70 as shown, for example, in FIGS. 2 and 3 is spaced from the hinge 16 that assists in preventing or inhibiting leakage from the container 10. Referring to the closed configuration of FIGS. 3 and 4*a* specifically, the second uninterrupted sealing area 70 sealingly engages the first uninterrupted sealing area 40 by use of matching surfaces. Specifically, the second generally outwardly projecting surface 72 of the lid 14 engages the second generally outwardly projecting ledge 42 of the base 12; the first generally upwardly projecting wall 74 of the lid 14 engages the second generally upwardly projecting wall 46 of the base 12; and the first generally outwardly projecting surface 76 of the lid 14 engages the first generally outwardly projecting ledge 44 of the base 12.

Figure 4A:
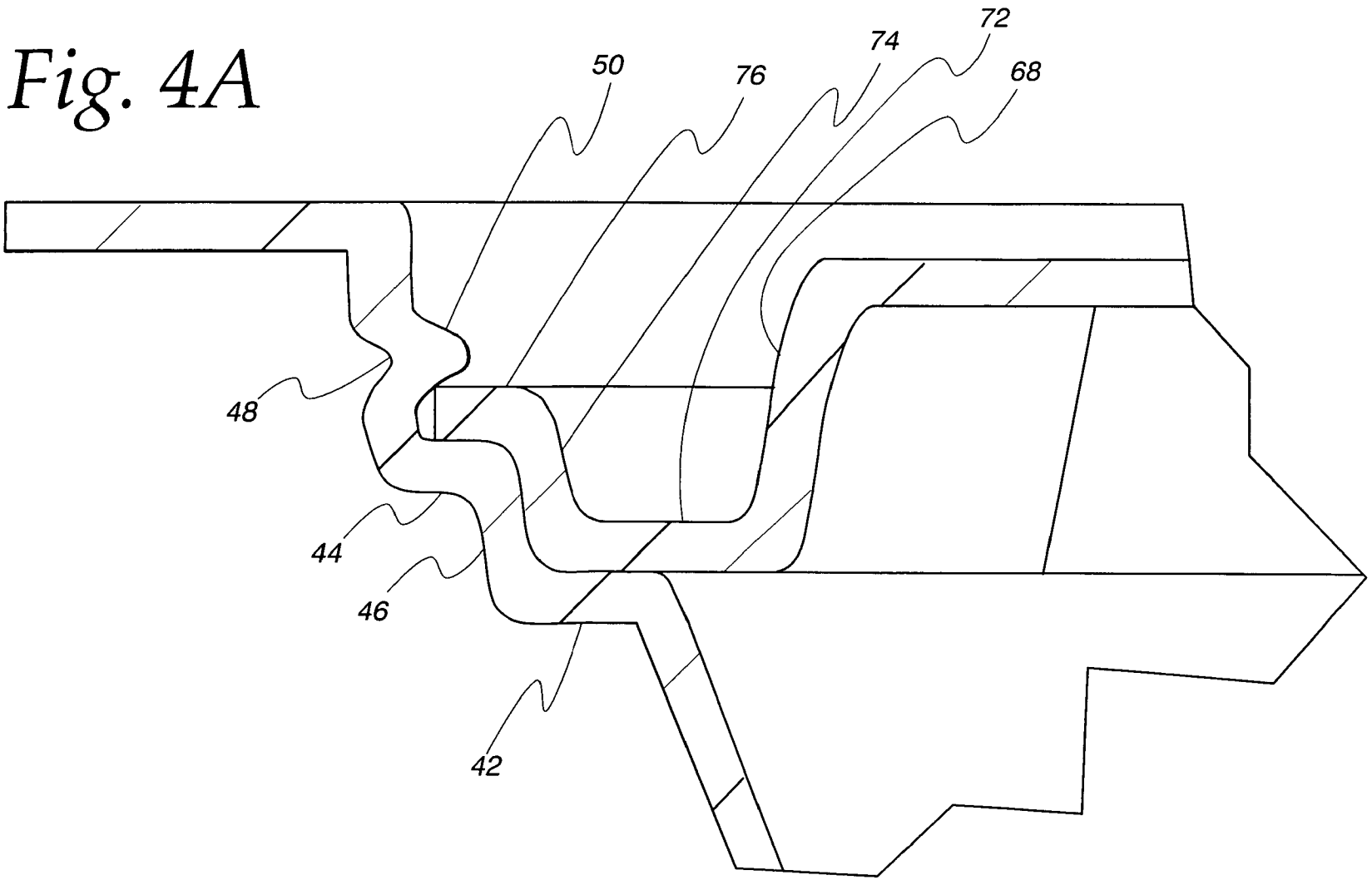
FIG. 4*a* is an enlarged cross-sectional view showing an undercut lock taken from generally circular area labeled FIG. 4 in FIG. 3.
Figure 4B:
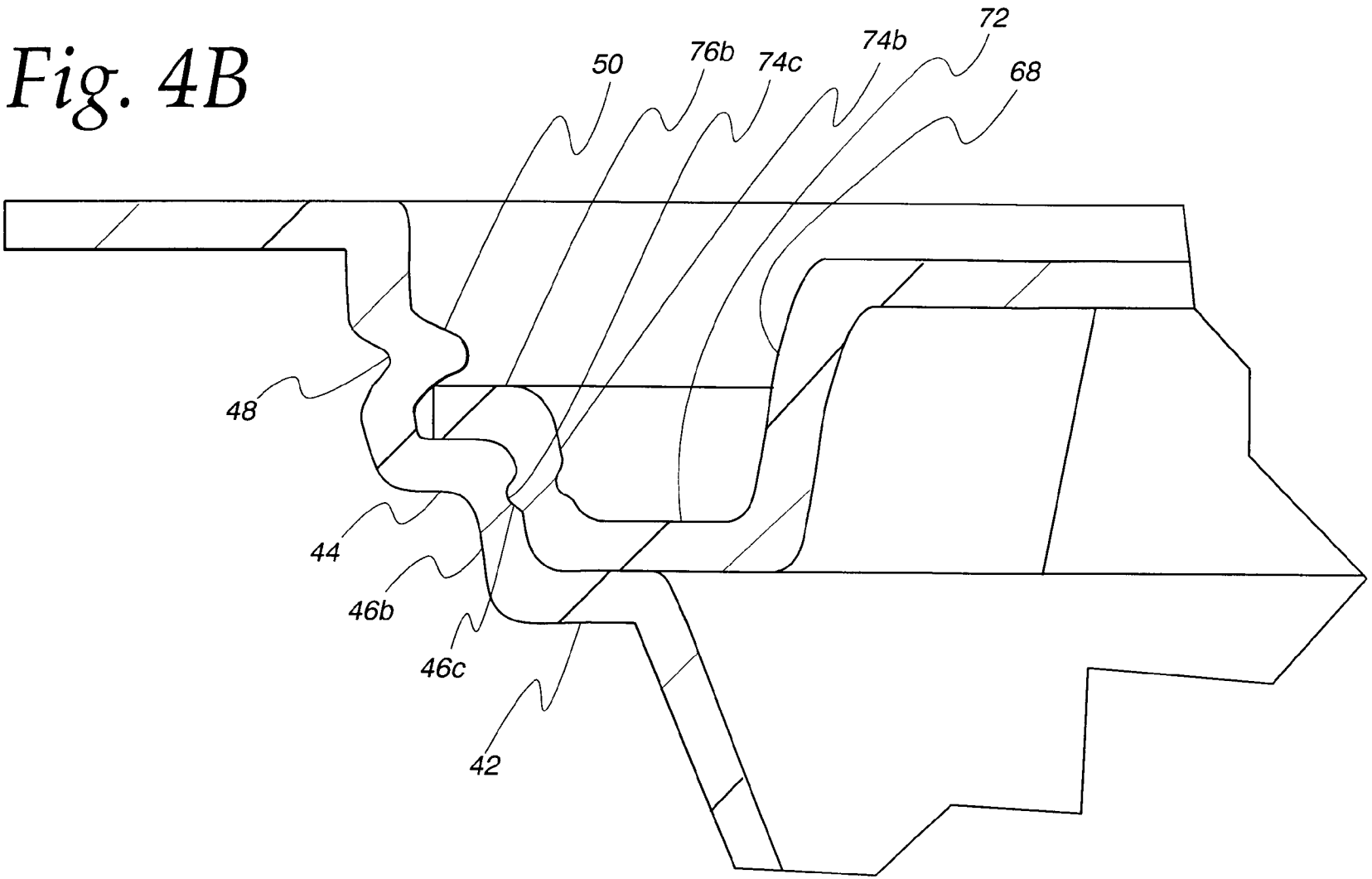
FIG. 4*b* is an enlarged cross-sectional view showing an undercut lock according to another embodiment.

According to another embodiment, as shown in FIG. 4*b*, a first generally upwardly projecting wall 74*b* includes an extension 74*c* that corresponds to a recess 46*c* formed in second generally upwardly projecting wall 46*b*. This extension and corresponding recess assist in forming a sealing area. The extension 74*c* of the first generally upwardly projecting wall 74*b* and recess 46*c* of the second generally upwardly projecting wall 46*b* may be used with the undercut 50 in securing the lid and the base as shown in FIG. 4*b*. Alternatively, the extension of the first generally upwardly projecting wall and recess of the second generally upwardly projecting wall may be used without an undercut. It is contemplated that the second generally upwardly projecting wall of the base may include an extension and the first generally upwardly projecting wall of the lid may form a corresponding recess.

It is contemplated that the first sealing area and the second sealing area may sealingly engage by using less than three surfaces. For example, it is contemplated that the first and second sealing areas may use one or two matching surfaces.

The diameter of the second sealing area 70 is preferably slightly greater than the diameter of the first sealing area 40 of the base 12 so as to create an amount of interference enforcing the surface-to-surface contact. This slightly greater diameter of the second sealing area 70 assists in allowing some tolerance in forming the base 12 and the lid 14 while still having a leak-resistant container. It is contemplated, however, that the diameter of the second sealing area 70 may be the same as the diameter of the first sealing area 40. Similarly, in non-circular embodiments, the linear dimension of the second sealing area of the lid is preferably slightly greater than the linear dimension of the first sealing area of the base so as to create an amount of interference enforcing the surface-to-surface contact.

In the closed container configuration (FIGS. 2–4*a*), the lid 14 is locked onto the base 12 by having the second generally horizontal surface 76 of the lid 14 snap under the plurality of undercuts 50 in the base 12. The plurality of undercuts 50 assists in maintaining the lid 14 and the base 12 in a closed position.

The lid 14 may also include at least one indentation such as, for example, a plurality of indentations 82 shown in FIG. 2. The indentation(s) may also be referred to as finger well(s). A user may position a finger and thumb in the plurality of indentations 82 and by squeezing, the second generally outwardly projecting surface 76 is moved from the plurality of undercuts 50 in effect unlocking the lid 14 from the base 12 to open the container 10. The plurality of indentations 82 is located generally opposite of the hinge 16 to assist in opening the container from a closed position. It is contemplated that the indentation(s) may be located in a different position than depicted in FIG. 2. It is also contemplated that the lid may not have such an indentation such as shown in the lid 114 of container 100 of FIG. 6.

The lid 114 of FIG. 6 also includes a sidewall 168 that includes a plurality of ribs 134. The sidewall 168 of the lid 114 is designed to correspond with the sidewall 120 of the base 112. The sidewall 168 includes a scalloped configuration that includes nine equidistant ribs like the sidewall 120 of the base 112 so as to be aesthetically pleasing with each other. The lid 114 also includes a tab extension 136 that assists a consumer in opening and closing the container 100. The tab extension 136 of the lid 112 works in conjunction with tab extension 152 of the base 112 to assist in opening the container 100.

The containers of the present invention are made of polymeric foam materials. It is contemplated that the foam containers may comprise materials such as alkenyl aromatic polymers, orientated polystyrene (OPS), polyolefins such as polypropylenes, polyesters such as polyethylene terephthalates (PET), high impact polystyrenes (HIPS), mineral-filled polymeric materials, or combinations thereof. Some non-limiting examples of mineral-filled polymeric foam materials include minerals such as talc, calcium carbonate or clay being used with foamed polymers such as polypropylenes, polyethylenes or polystyrenes. The lid and the base may be made from the same foam or a different foam.

The foam containers of the present invention are typically disposable, but it is contemplated that they may be reused at a future time. It is also contemplated that the foam containers may be made of materials that can be used in heating apparatus such as microwavable ovens and/or used in the dishwasher. The foam containers of the present invention preferably have a leak resistance when properly sealed that enable the containers to be held at different angles and shaken with no leakage.

The height and shape of, for example, the base 12 and/or the lid 14 may vary from that shown in FIGS. 1 and 2. The foam container 10 of the present invention is shown as being generally circular in shape. It is contemplated that the foam container may be of other shapes such as oval, and polygonal shapes like rectangular and hexagonal. It is desirable, however, to use a generally circular shaped container because of the high leak resistance achieved with such a shape. While not being bound by theory, it is believed that the stress is more evenly distributed using a generally circular shaped container, which results in an improved leak resistance.

The containers of the present invention may be formed using conventional thermoforming (e.g., by pressure, vacuum or the combination thereof). According to one method of thermoforming, pellets of a polymeric resin and additives, if any, are added into an extruder. The pellets of the polymeric resin and additives, if any, are melted to form a blend. The blend is extruded through a die to form an extruded sheet. The extruded sheet is thermoformed to a desired shape of a foam container.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall, the first sealing area including a first generally outwardly projecting ledge, a second generally outwardly projecting ledge, and a second generally upwardly projecting wall, the second generally upwardly projecting wall encompassing and extending generally upwardly from the second generally outwardly projecting ledge, the first generally outwardly projecting ledge encompassing and extending generally outwardly from the second generally upwardly projecting wall, the first generally upwardly projecting wall encompassing and extending generally upwardly from the first generally outwardly projecting ledge;

a hinge being connected to the base; and a lid being pivotally connected to the base by the hinge, between a closed position to engage the base upon closure of the container and an open position to disengage the base upon opening of the container, the lid including a second sealing area that is adapted to engage the first generally outwardly projecting ledge, the second generally outwardly projecting ledge, and the second generally upwardly projecting wall of the first sealing area upon securing the lid and the base in the closed position, wherein the container forms locking means for securing the lid and the base and wherein the base comprises a polymeric foam and the lid comprises a polymeric foam.

2. The container of claim 1, wherein the hinge is connected to the first generally upwardly projecting wall of the base.

3. The container of claim 1, wherein the first and second sealing areas are continuous.

4. The container of claim 3, wherein the first sealing area and the second sealing area are spaced from the hinge to allow an uninterrupted seal between the first and second continuous sealing areas upon securing the lid and the base.

5. The container of claim 1, wherein the second sealing area includes a first generally outwardly projecting surface, a second generally outwardly projecting surface, and a first generally upwardly projecting wall, the first generally upwardly projecting wall encompasses and bridges the first and second generally outwardly projecting surfaces.

6. The container of claim 5, wherein the first generally upwardly projecting wall of the second sealing area forms an extension, the second generally upwardly projecting wall forms a recess therein, the extension is adapted to fit into the recess.

7. The container of claim 1, wherein the first generally outwardly projecting ledge is generally horizontal, the second generally outwardly projecting ledge is generally horizontal, and the second generally upwardly projecting wall is generally vertical.

8. The container of claim 1, wherein locking means is at least one undercut, slot and tab closures, a continuous undercut ring, a discontinuous undercut ring or combinations thereof.

9. The container of claim 1, wherein the container has a recessed portion and a raised portion that is adapted to correspond to the recessed portion of a second container so as to assist in stacking a plurality of the containers.

10. The container of claim 1, wherein the base further including a tab extension to assist in opening and closing the container, the tab extension encompasses and extends outwardly from the first generally upwardly projecting wall of the base.

11. The container of claim 1, wherein the lid further includes a tab extension to assist in opening the container.

12. The container of claim 1, wherein the lid further includes at least one indentation located generally opposite of the hinge to assist in opening the container from a closed position.

13. The container of claim 1, wherein a portion of the hinge extends downwardly towards the bottom wall.

14. The container of claim 13, wherein the portion of the hinge extends at least ¼ of an inch below an upper edge of the first generally upwardly extending wall.

15. The container of claim 1, wherein the first generally upwardly projecting wall is generally vertical.

16. The container of claim 1, wherein the polymeric foam container comprises an alkenyl aromatic polymer.

17. The container of claim 1, wherein the container is generally circular and the diameter of the second sealing area is greater than the diameter of the first sealing area.

18. The container of claim 1, wherein the container is generally circular and diameter of the second sealing area is the same as the diameter of the first sealing area.

19. The container of claim 1, wherein the first generally upwardly projecting wall forms locking means for securing the lid and the base.

20. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall encompassing the first sealing area;

a hinge being connected to the base, the hinge when in a closed position comprising a first generally horizontal portion, a second generally horizontal portion, and a first generally vertical portion that are integrally connected to each other, the second generally horizontal portion being folded over the first generally horizontal portion, the first generally vertical portion extending generally downwardly from the second generally horizontal portion towards the bottom wall; and a lid having an outer perimeter and being hingedly connected to the base by the hinge, the lid being adapted to be pivoted about the hinge to engage the base upon closure of the container, the lid including a second sealing area that is adapted to engage the first sealing area upon securing the lid and the base, wherein the first generally upwardly projecting wall surrounds the outer perimeter of the lid, the container forms locking means for securing the lid and the base and wherein the base comprises a polymeric foam and the lid comprises a polymeric foam.

21. The container of claim 20, wherein the first sealing area of the base includes a second generally upwardly projecting wall and a first generally outwardly projecting ledge, the second generally upwardly projecting wall encompasses the first generally outwardly projecting ledge.

22. The container of claim 21, wherein the second generally upwardly projecting wall extends downwardly from the first generally outwardly projecting ledge towards the bottom wall.

23. The container of claim 21, wherein the second generally upwardly projecting wall extends upwardly from the first generally outwardly projecting ledge.

24. The container of claim 20, wherein locking means is at least one undercut, slot and tab closures, a continuous undercut ring, a discontinuous undercut ring or combinations thereof.

25. The container of claim 20, wherein the container has a recessed portion and a raised portion that is adapted to correspond to the recessed portion of a second container so as to assist in stacking a plurality of the containers.

26. The container of claim 20, wherein the first generally upwardly projecting wall is generally vertical.

27. The container of claim 20, wherein the polymeric foam container comprises an alkenyl aromatic polymer.

28. The container of claim 20, wherein the first generally upwardly projecting wall forms locking means for securing the lid and the base.

29. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall, the first sealing area including a first generally outwardly projecting ledge, a second generally outwardly projecting ledge, and a second generally upwardly projecting wall, the second generally upwardly projecting wall encompassing and extending generally upwardly from the second generally outwardly projecting ledge, the first generally outwardly projecting ledge encompassing and extending generally outwardly from the second generally upwardly projecting wall, the first generally upwardly projecting wall encompassing and extending generally upwardly from the first generally outwardly projecting ledge;

a hinge being connected to the base; and a lid having an outer perimeter and being pivotally connected to the base by the hinge between a closed position to engage the base upon closure of the container and an open position and to disengage the base upon opening of the container, the lid including a second sealing area that is adapted to engage the first sealing area upon securing the lid and the base in the closed position, with the first generally upwardly projecting wall surrounding the outer perimeter of the lid, wherein the first generally upwardly projecting wall forms at least one undercut that extends over the second sealing area of the lid upon securing the lid and the base, and wherein the base comprises a polymeric foam and the lid comprises a polymeric foam.

30. The container of claim 29, wherein the first generally upwardly projecting wall forms a plurality of undercuts.

31. The container of claim 29, wherein the first generally outwardly projecting ledge is generally horizontal, the second generally outwardly projecting ledge is generally horizontal, and the second generally upwardly projecting wall is generally vertical.

32. The container of claim 29, wherein the first generally upwardly projecting wall is generally vertical.

33. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall encompassing the first sealing area;

a hinge being connected to the base, the hinge when in a closed position comprising a first generally horizontal portion, a second generally horizontal portion, and a first generally vertical portion that are integrally connected to each other, the second generally horizontal portion being folded over the first generally horizontal portion, the first generally vertical portion extending generally downwardly from the second generally horizontal portion towards the bottom wall; and a lid having an outer perimeter being hingedly connected to the base by the hinge, the lid being adapted to be pivoted about the hinge to engage the base upon closure of the container, the lid including a second sealing area that is adapted to engage the first sealing area upon securing the lid and the base with the first generally upwardly projecting wall surrounding the outer perimeter of the lid, wherein the first generally upwardly projecting wall forms at least one undercut that extends over the second sealing area of the lid upon securing the lid and the base, and wherein the base comprises a polymeric foam and the lid comprises a polymeric foam.

34. The container of claim 33, wherein the first generally upwardly projecting wall forms a plurality of undercuts.

35. The container of claim 33, wherein the first generally outwardly projecting ledge is generally horizontal, the second generally outwardly projecting ledge is generally horizontal, and the second generally upwardly projecting wall is generally vertical.

36. The container of claim 33, wherein the first generally upwardly projecting wall is generally vertical.

37. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall, the first sealing area including a first generally outwardly projecting ledge, a second generally outwardly projecting ledge, and a second generally upwardly projecting wall, the second generally upwardly projecting wall encompassing and extending generally upwardly from the second generally outwardly projecting ledge, the first generally outwardly projecting ledge encompassing and extending generally outwardly from the second generally upwardly projecting wall, the first generally upwardly projecting wall encompassing and extending generally upwardly from the first generally outwardly projecting ledge;

a hinge being connected to the base, the hinge when in a closed position comprising a first generally horizontal portion, a second generally horizontal portion, and a first generally vertical portion that are integrally connected to each other, the second generally horizontal portion being folded over the first generally horizontal portion, the first generally vertical portion extending downwardly from the second generally horizontal portion towards the bottom wall; and a lid having an outer perimeter and being hingedly connected to the base by the hinge, the lid being adapted to be pivoted about the hinge to engage the base upon closure of the container, the lid including a second sealing area that is adapted to engage the first generally outwardly projecting ledge, the second generally outwardly projecting ledge, and the second generally upwardly projecting wall of the first sealing area upon securing the lid and the base;

wherein the first generally upwardly projecting wall surrounds the outer perimeter of the lid and forms at least one undercut that extends over the second sealing area of the lid upon securing the lid and the base, and wherein the base comprises a polymeric foam and the lid comprises a polymeric foam.

38. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall, the first sealing area including a first generally outwardly projecting ledge, a second generally outwardly projecting ledge and a second generally upwardly projecting wall, the second generally upwardly projecting wall encompassing and extending generally upwardly from the second generally outwardly projecting ledge the first generally outwardly projecting ledge encompassing and extending generally outwardly from the second generally upwardly projecting wall, the first generally upwardly projecting wall encompassing and extending generally upwardly from the first sealing area;

a hinge being connected to the base; and a lid being pivotally connected to the base by the hinge between a closed position to engage the base upon closure of the container and an open position to disengage the base upon opening of the container, the lid including a second sealing area that is adapted to engage the first generally outwardly projecting ledge, the second generally outwardly projecting ledge and the second generally upwardly projecting wall of the first sealing area of the base upon securing the lid and the base in the closed position, the second sealing area including a first generally outwardly projecting surface and a first generally upwardly projecting wall, the first generally upwardly projecting wall of the lid encompassing the first generally outwardly projecting surface, wherein one of the first sealing area and the second sealing area forms a projection and the other one of the first sealing area and the second sealing area forms a corresponding recess for securing the lid and the base and wherein the base comprises a polymeric foam and the lid comprises a polymeric foam.

39. The container of claim 38, wherein the first sealing area forms the recess and the second sealing area forms the projection.

40. The container of claim 38, wherein the second generally upwardly projecting wall of the first sealing area forms the recess and the first generally upwardly projecting wall of the second sealing area forms the projection.

41. The container of claim 38, wherein the first sealing area further including a second generally outwardly projecting ledge, the second generally upwardly projecting wall encompassing and extending generally upwardly from the second generally outwardly projecting ledge, the first generally outwardly projecting ledge encompassing and extending generally outwardly from the second generally upwardly projecting wall, the first generally upwardly projecting wall encompassing and extending generally upwardly from the first generally outwardly projecting ledge.

42. The container of claim 38, wherein the second generally upwardly projecting wall extends generally upwardly from the first generally outwardly projecting ledge.

43. A leak-resistant hinged polymeric foam container, comprising:

a base comprising a bottom wall and a sidewall encompassing and extending generally upwardly from the bottom wall, the sidewall comprising a first sealing area and a first generally upwardly projecting wall encompassing the first sealing area;

a hinge being connected to the base, the hinge when in a closed position comprising a first generally horizontal portion, a second generally horizontal portion, and a first generally vertical portion that are integrally connected to each other, the second generally horizontal portion being folded over the first generally horizontal portion, the first generally vertical portion extending downwardly from the second generally horizontal portion towards the bottom wall; and a lid having an outer perimeter being hingedly connected to the base by the hinge, the lid being adapted to be pivoted about the hinge to engage the base upon closure of the container, the lid including a second sealing area that is adapted to engage the first sealing area upon securing the lid and the base, wherein the first generally upwardly projecting wall surrounds the outer perimeter of the lid, one of the first sealing area and the second sealing area forms a projection and the other one of the first sealing area and the second sealing area forms a corresponding recess for securing the lid and the base and wherein the base comprises a polymeric foam and the lid comprises a polymeric foam.

44. The container of claim 43, wherein the first sealing area forms the recess and the second sealing area forms the projection.

45. The container of claim 43, wherein the first sealing-area further including forms a second generally outwardly projecting ledge, the second generally upwardly projecting wall encompassing and extending generally upwardly from the second generally outwardly projecting ledge, the first generally outwardly projecting ledge encompassing and extending generally outwardly from the second generally upwardly projecting wall, the first generally upwardly projecting wall encompassing and extending generally upwardly from the first generally outwardly projecting ledge.

46. The container of claim 43, wherein the second generally upwardly projecting wall extends generally upwardly from the first generally outwardly projecting ledge.

* * * * *